United States Patent [19]

Capella

[11] 4,257,596

[45] Mar. 24, 1981

[54] BOWLER'S DIGIT COMPRESSION DEVICE AND METHOD

[76] Inventor: Eugene Capella, 417 46th St., Lindenhurst, N.Y. 11757

[21] Appl. No.: 25,110

[22] Filed: Mar. 29, 1979

Related U.S. Application Data

[63] Continuation-in-part of Ser. No. 809,555, Jun. 24, 1977, abandoned.

[51] Int. Cl.[3] ..... A63B 71/04

[52] U.S. Cl. ..... 273/54 B; 2/21; 24/16 PB; 24/17 A; 24/278

[58] Field of Search ..... 273/54 R, 54 B; 2/21; 128/87 A; 294/25; 24/16 PB, 17 A, 278

[56] References Cited

U.S. PATENT DOCUMENTS

| | | | |
|---|---|---|---|
| 460,104 | 9/1891 | Barrett | 2/21 UX |
| 1,040,761 | 10/1912 | Rives | 273/149 R UX |
| 1,306,442 | 6/1919 | Sansotta | 2/21 |
| 2,391,235 | 12/1945 | Hathorn | 24/278 |
| 2,932,982 | 4/1960 | Enders | 24/278 X |
| 3,421,761 | 1/1969 | Grant | 273/54 B |
| 3,606,342 | 9/1971 | Albertson | 273/54 B X |
| 3,744,096 | 7/1973 | Kok | 24/278 |
| 4,008,512 | 2/1977 | Prodel | 24/16 PB |

*Primary Examiner*—Anton O. Oechsle
*Attorney, Agent, or Firm*—Bernard Malina

[57] ABSTRACT

A bowling aid device and method are operative to circumferentially compress the knuckle portion of a bowler's digit and reduce the same prior to insertion of the digit into the corresponding digit hole of a bowling ball. The device comprises a flexible and inextensible strip-like or ring-like compression member adapted to be applied completed around the knuckle and adjustable locking means operative to tighten the compression member in wrap-around compressive engagement with the knuckle for a preselected period of time. The resultant circumferential reduction of the knuckle provides optimum sliding engagement of the reduced digit within the corresponding digit hole in the bowling ball and improved bowling performance.

3 Claims, 10 Drawing Figures

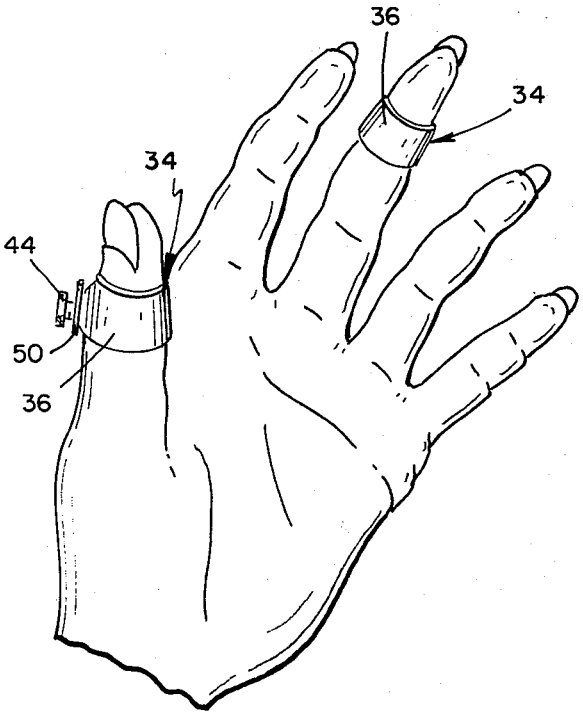
FIG. 8
FIG. 10
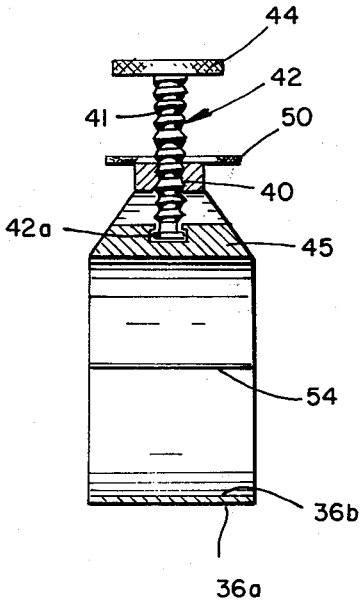
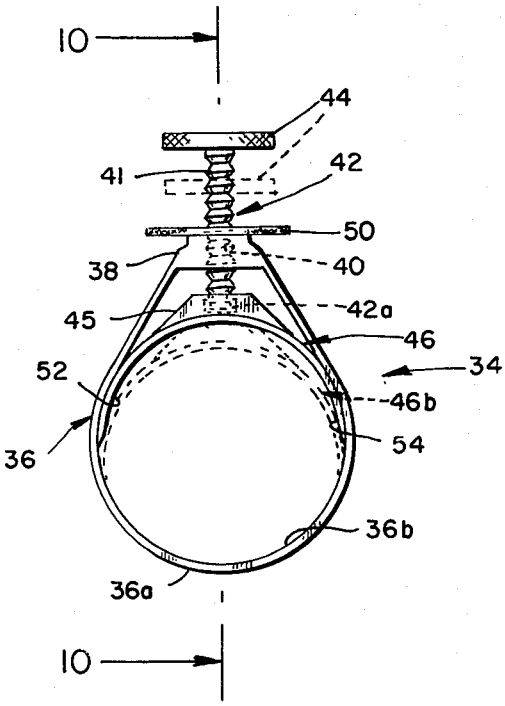
FIG. 9

BOWLER'S DIGIT COMPRESSION DEVICE AND METHOD

BACKGROUND OF THE INVENTION

This application is a continuation-in-part of my copending application Ser. No. 809,555 filed June 24, 1977, abandoned.

The present invention relates to bowling aids and more particularly to a device which permits the user to achieve greater consistent control at the release of the bowling ball in the delivery stroke.

Conventional bowling balls are provided with three triangularly spaced cylindrical holes drilled in the ball for slidably accommodating the thumb and the two middle fingers respectively. The remaining fingers which are not inserted into these finger holes, i.e., the external fingers, serve to hold the ball securely in the bowler's hand during the approach and delivery. In conventional bowling balls designed for beginners, the above-mentioned finger holes are drilled with a zero pitch, i.e., they are oriented radially to the geometric center of the ball.

Expert bowlers have found that in order to obtain greater control over the release of the ball when executing the delivery thereof, they prefer to have the thumbhole drilled at a specific pitch, i.e., angular offset from the radial, in order to permit the thumb to withdraw earlier from the thumbhole than in zero-pitch bowling balls during the release portion of the delivery stroke. It has been found that such earlier thumb withdrawal permits the bowler to impart a greater spin to the ball upon release which in turn increases the "pin-mixing" power, the ability to cause pins directly struck by the ball to strike down the remaining pins in "domino" fashion.

It has been found that a pitch in the thumbhole corresponding to an offset of about one-quarter inch on the ball surface in a direction away from the palm and about one-quarter inch away from the fingers in satisfactory for most experienced bowlers. Furthermore, a pitch in the finger holes corresponding to an offset of about one-quarter inch on the ball surface in a direction toward the thumbhole has also been found satisfactory for most experienced bowlers. Some bowlers, however, have found that they cannot hold and control a bowling ball having such pitches and prefer finger holes of opposite pitches.

Although the above-described pitches in the thumb and finger holes provide greater control and more "mixing" power, it has been found that as a result of prolonged bowling callouses develop on the thumb and inserted fingers of the bowler as a result of the increased friction between the inserted digit and the interior wall surfaces of the pitched thumb and finger holes.

It has been found that the inserted digits of a bowler tend to shrink diametrically, i.e., in width, to some extent after bowling several games. The degree of such shrinkage varies with the individual bowler and is in part determined by the ambient room temperature and humidity. Accordingly experienced bowlers select balls having thumb and finger holes of a size which provide a relatively tight fit at the outset of the bowling session, but are subsequently found to be of a satisfactory size after several "warm-up" games due to the above-mentioned shrinkage of the bowler's thumb and inserted fingers.

For obvious reasons, it is desirable to minimize, if not eliminate entirely, the necessity for an experienced bowler to play several "warm-up" games in order to reduce the width of the thumb and inserted fingers to an optimum size.

It is, therefore, an object of the present invention to provide a method operative to reduce the knuckle portion of the bowler's digit prior to insertion thereof into a digit hole of the bowling ball for bowling.

It is another object of the present invention to provide a method of the character described which is operative to effect such digit reduction to a pre-selected degree.

It is yet another object of the present invention to provide a method of the character described which is operative to effect such digit reduction to variably preselected degrees.

It is a further object of the present invention to provide a method of reducing the knuckle portion of a bowler's digit prior to insertion thereof into a digit hole of a bowling ball.

SUMMARY OF THE INVENTION

In accordance with the principles of the present invention, there is provided a method of reducing the knuckle portion of a bowler's digit prior to insertion thereof into a digit hole of a bowling ball for bowling purposes, which method comprises the following steps: Applying a flexible non-extensible compression member having a smooth inner surface on the knuckle portion of the digit so that the compression member inner surface circumferentially completely overlies the knuckle portion; tightening the compression member on the digit whereby the compression member inner surface is in direct continuous compressive contact with said knuckle portion; and increasing the tightening force on the compression member to cause diametrical reduction of the knuckle to a predetermined size.

Further objects, features and advantages of the present invention will become apparent from a consideration of the following description; the appended claims and the accompanying drawings in which:

BRIEF DESCRIPTION OF THE DRAWINGS

FIG. 8 is a perspective view of the present invention in a third embodiment thereof, showing the device in the operative condition mounted on the thumb and also on one finger;

FIG. 9 is an elevation view of the device of FIG. 8; and

FIG. 10 is a section view taken along the line 10—10 of FIG. 9.

DETAILED DESCRIPTION OF THE INVENTION

Figure 1:
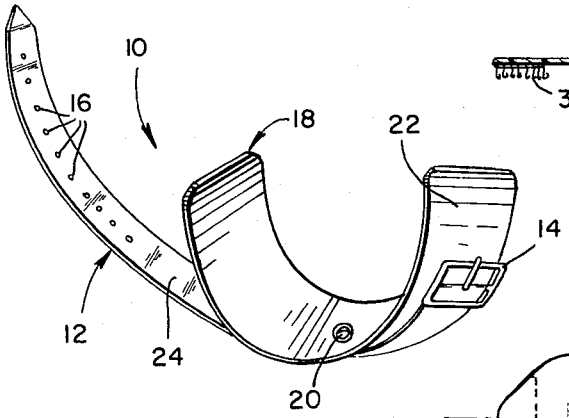
FIG. 1 is a perspective view of the present invention in one embodiment thereof, showing the device of the present invention in one embodiment thereof in the open unmounted position.

Referring to the drawings, and in particular to FIG. 1 thereof, the device of the present invention in one embodiment thereof is generally designated by the numeral 10. Device 10 comprises a flat mounting strap 12 made of suitable thin flexible material such as leather, nylon, plastic or the like, having a buckle 14 secured to one end thereof and a plurality of spaced eyelets 16 at the opposite end thereof.

A curled compression member 18 in the form of an elongated strip of sufficient length to wrap completely around the digit is fixedly secured at one or more points 20 at its outer surface 22 to the inner surface 24 of strap 12. Compression member 18 should be made of thin flexible material which is inextensible when applied to the digit. Member 18 should also be smooth on its inner surface 18*a* which is in direct contact with the digit when the device is applied thereto and tightened. By way of example, materials suitable for compression member 18 include pressed polished acetate, vinyl or hard rubber and may be of sufficient stiffness to retain some degree of curl in the relaxed condition when device 10 is in the inoperative condition, as shown in FIG. 1.

Compression member 18 may be fixedly secured to strap 12 by any conventional means depending on the materials of compression member 18 and strap 12 respectively, such as heat sealing, epoxy binder, riveting, etc.

Figure 3:
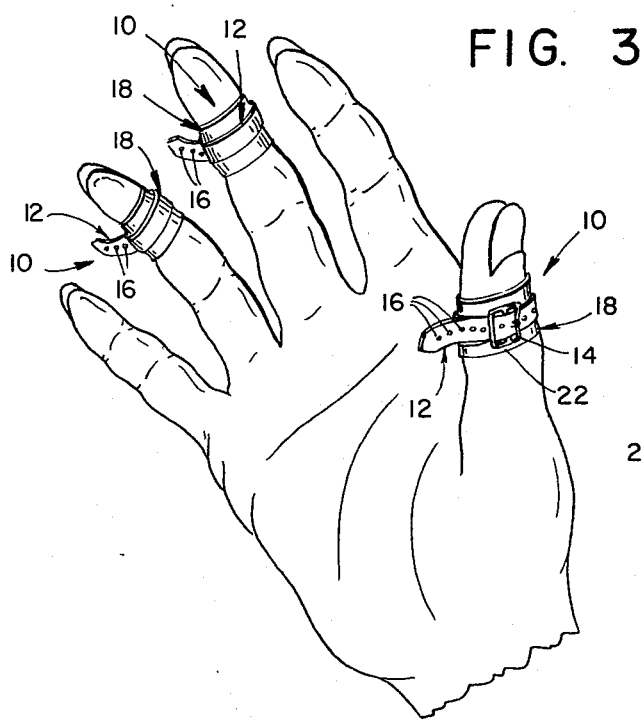
FIG. 3 is a perspective view of the device of FIG. 1 showing the device in the operative condition mounted on the thumb and fingers.

Device 10 is applied to the knuckle portion of each digit which is inserted into the digit holes of the bowling ball when bowling. Thus, as shown in FIG. 3, devices 10 are respectively applied to the knuckle of thumb, middle and ring fingers in the following manner. Thus, for the thumb, the compression member 18 is wrapped around the knuckle portion of the thumb and the buckle 12 is tightened and locked to a selected position. The selected position of the buckle lock when tightened is determined by the size, i.e. circumference of the thumb knuckle and the degree of compression force necessary to be applied thereto to cause it to reduce to the appropriate size for proper fit in the thumbhole (not shown) of the bowling ball. Similarly, devices 10 are also applied to the knuckle portions of the middle and ring fingers. The degree of tightness of the devices 10 as applied and the time period of application thereof to achieve the desired reduction of the digit and consequent proper fit of the digit in the corresponding hole of the bowling ball is determined by trial and error. After the desired degree of digit reduction has been achieved, the digit is released by unbuckling buckle 14, whereupon the reduced digit is ready for insertion into the corresponding digit hole of the bowling ball for bowling.

Figure 7:
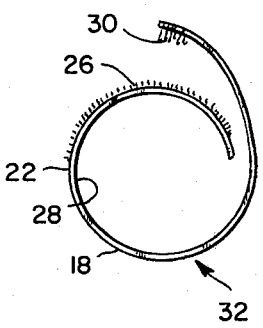
FIG. 7 is an end view of the device of FIG. 5 in the curled condition.
Figure 6:
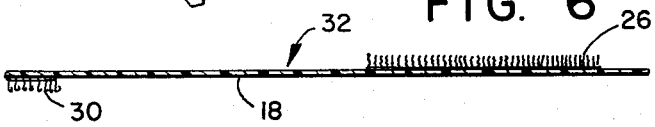
FIG. 6 is a section view taken along the line 6—6 of FIG. 5.

It is understood that adjustable fastener means other than the belt 12 and buckle 14 may be used to wrap and tighten compression member 18 about the digit. Thus, referring to FIGS. 5, 6 and 7 wherein like reference numerals refer to like or similar parts in the several figures, a strip 26 of fibrous gripping material such as that sold under the trademark Velcro may be bonded or otherwise secured directly to the outer surface 22 of compression member 18 at one end thereof and a mating short strip 30 of fibrous gripping material may be likewise bonded or otherwise secured directly to the inner surface 28 of compression member 18 at the tail end thereof to form another embodiment 32 of the present invention.

Devices 32 are respectively applied to the knuckle portions of the thumb, middle and ring fingers and tightened as described above with respect to device 10. Locking strip 30 is then pressed to engage matching strip 26 at an appropriate location thereon to achieve the desired compression.

It is important that the compressive force applied to the knuckle portion of tht digit by devices 10 and 32 be substantially uniform over the circumference of the knuckle. For this reason it is essential that the inner surface 18*a* of compression member 18 be smooth, and that member 18 be flexible and inextensible, i.e. nonstretchable. Materials having these characteristics rendering them suitable for use for compression member 18 include pressed polished acetate, vinyl and hard rubber. Fibrous materials, for example, are generally unsuitable for such use since they tend to stretch when stressed, and generally do not have a sufficiently smooth surface.

FIGS. 8–10, illustrate a clamp-type device 34 in accordance with the present invention in another embodiment thereof. Device 34 includes an outer ring 36 having a circular lower portion 36*a* extending upwardly into an integrally formed head piece 38. Head piece 38 has a threaded through aperture 40 which threadably receives the screw-threaded shank 41 of a bolt 42 provided at its upper end with a knuckled bolt head 44.

Referring spefically to FIG. 9, a semi-circular half-ring 46 is slidably mounted facing downward within the interior of outer ring 36 and is movable to a limited extent in the vertical direction within outer ring 36 from an extended upper position indicated by the solid outline to a lower contracted position indicated by broken outline 46*b*. The lower end 42*a* of bolt 42 is journalled for free rotation in the thickened reinforcing wall 45 formed in the upper end of inner ring 46 so that rotation of bolt head 44 which carries inner ring 46 at the lower end thereof serves to raise and lower the same.

Figure 5:
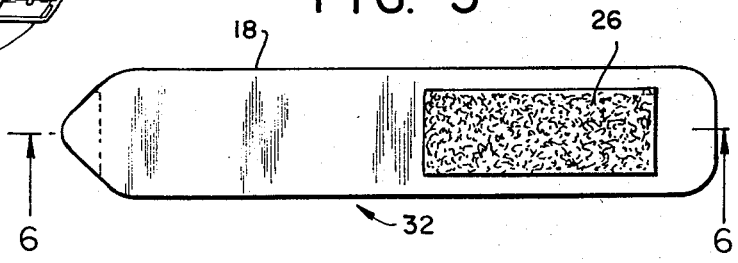
FIG. 5 is a plan view of the present invention in a second embodiment thereof, showing the device in the flat unmounted condition.
Figure 4:
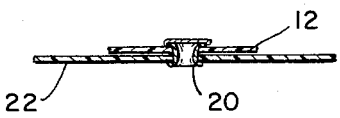
FIG. 4 is a section view taken along the line 4—4 of FIG. 2.
Figure 2:
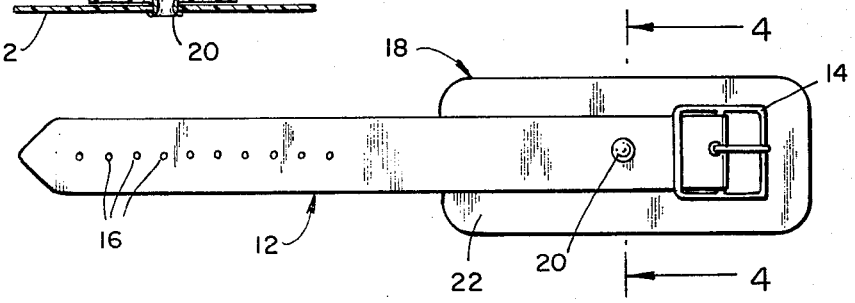
FIG. 2 is a plan view of the device of FIG. 1 showing the same in the flat unmounted condition.

Inner ring 46 which is inextensible and smooth on its inner surface 46*c* is made of material similar to that used for compression member 18 in the embodiments of FIGS. 1 and 5. Outer ring 36 may be made of similar material which is likewise inextensible and smooth on its inner surface 36*b* but of increased thickness and therefore of increased stiffness.

In operation, the bowler inserts his digit into the device 34 when inner ring 46 is in the raised or extended position. He then lowers inner ring 46 into the lower position until the digit is circumferentially clamped by the action of inner ring 46 and the lower portion 36 of outer ring 36. Inner ring 36 is then locked into the lower clamped position by rotating locking nut 50 until it abuts the upper surface of reinforcing wall 38, thereby locking bolt 42 against further movement in the vertical direction. The digit may be subsequently released from the device when desired by turning lock nut 50 and thereafter bolt head 44 in the reverse direction.

It is noted that when inner ring 46 is lowered, the outer surfaces of its flexible wing portions 52, 54 which are tapered at their respective ends make continuous sliding contact with the inner surface of outer ring 36 due to the spring-like action of wing portions 52, 54 which urges them apart against the inner surface of outer ring 36. As a result, wing portions 52 and 54 making contact with the lower inner surface of outer ring 36 assume the curvature of the latter.

In the case of all the above-described embodiments of the present invention, the device is maintained on the digit in the compressed condition for a period of time sufficient to achieve the desired reduction in the size of the knuckle portion of the digit. The digits are then released from their respective devices and the bowler will then be ready for bowling. He will find that as a result of the application of the device, the digits inserted into the bowling ball digit holes experience optimum frictional force therebetween thereby providing improved control over the release of the ball in the delivery stroke.

Although the invention has been described with reference to particular embodiments thereof, it is to be understood that these embodiments are merely illustrative of the application of the principles of the invention. Numerous modifications may be made therein and other arrangements may be devised without departing from the spirit and scope of the invention.

What is claimed is:

1. The method of reducing the knuckle portion of a bowler's digit prior to insertion thereof into a digit hole of a bowling ball for bowling, which method comprises:

(a) applying flexible non-extensible compression member means having a smooth inner surface on the knuckle portion of the digit so that said inner surface circumferentially completely overlies said knuckle portion;

(b) tightening said compression member means on said knuckle portion whereby said inner surface is in direct continuous compressive contact therewith; and (c) increasing the tightening force on said compression member to cause diametrical reduction of the knuckle to a predetermined size.

2. The method of claim 1, in which step (c) is followed by the step of maintaining said tightening force on said compression force for a preselected period of time.

3. The method of claim 2, which includes the subsequent step of bowling.

* * * * *